US009010346B2

(12) United States Patent
Stankiewicz

(10) Patent No.: US 9,010,346 B2
(45) Date of Patent: Apr. 21, 2015

(54) PERSONAL COOLING APPARATUS

(71) Applicant: Frances Stankiewicz, Hebron, CT (US)

(72) Inventor: Frances Stankiewicz, Hebron, CT (US)

( * ) Notice: Subject to any disclaimer, the term of this patent is extended or adjusted under 35 U.S.C. 154(b) by 0 days.

(21) Appl. No.: 13/966,572

(22) Filed: Aug. 14, 2013

(65) Prior Publication Data

US 2014/0048110 A1 Feb. 20, 2014

Related U.S. Application Data

(60) Provisional application No. 61/683,510, filed on Aug. 15, 2012.

(51) Int. Cl.
*A45B 23/00* (2006.01)
*A45B 3/00* (2006.01)

(52) U.S. Cl.
CPC . *A45B 23/00* (2013.01); *A45B 3/00* (2013.01); *A45B 2200/1036* (2013.01)

(58) Field of Classification Search
CPC ..... A45B 23/00; A45B 2200/1009; A45B 2200/1045
USPC ..... 135/91, 93, 98, 16, 25.4; 239/289, 375, 239/379; 62/310–314; 454/370
See application file for complete search history.

(56) References Cited

U.S. PATENT DOCUMENTS 3,444,799 A * 5/1969 Covington ..... 454/370
3,881,198 A 5/1975 Waters
4,141,083 A 2/1979 Waters
4,998,415 A 3/1991 Larsen
5,207,238 A * 5/1993 Rivera et al. ..... 135/16
5,349,975 A * 9/1994 Valdner ..... 135/16
5,353,605 A 10/1994 Naaman
5,979,793 A 11/1999 Louis
6,119,689 A * 9/2000 Korman ..... 128/205.29
6,257,011 B1 7/2001 Siman-Tov et al.
6,318,390 B1 * 11/2001 Innis ..... 135/20.2
6,886,759 B1 5/2005 Okronick et al.
7,117,687 B2 10/2006 Naaman
7,322,208 B1 1/2008 Griffin
7,331,183 B2 2/2008 Askew
7,412,984 B1 8/2008 Spencer et al.
7,513,126 B2 * 4/2009 Boland ..... 62/310
7,748,235 B1 * 7/2010 Franklin et al. ..... 62/420
8,069,868 B2 * 12/2011 Kuelbs ..... 135/16
8,695,614 B2 * 4/2014 Chaimovski et al. ..... 135/16
2002/0078985 A1 6/2002 Farr
2008/0048051 A1 * 2/2008 Chang ..... 239/289
2009/0283121 A1 * 11/2009 Chu ..... 135/16
2011/0146319 A1 * 6/2011 Branning ..... 62/259.4

* cited by examiner

*Primary Examiner* — Winnie Yip
(74) *Attorney, Agent, or Firm* — Buckingham, Doolittle & Burroughs, LLC

(57) ABSTRACT

A portable sun screen and cooling apparatus for shading a user from direct sunlight while circulating cooled air. The portable sun screen and cooling apparatus provides a domed canopy with an air conditioning element that circulates cooled air throughout the domed canopy. The domed canopy comprises a hollow framework for redirecting the cooled air toward a user's upper body. An indicating element demonstrates a user's position should they become lost or separated from their companions.

7 Claims, 3 Drawing Sheets

PERSONAL COOLING APPARATUS

CROSS-REFERENCE

This application claims priority from Provisional Patent Application Ser. No. 61/683,510 filed Aug. 15, 2012.

FIELD OF THE INVENTION

This invention pertains generally to a portable sun screen and cooling apparatus, and more particularly to a umbrella that circulates cooled air around a user's head and torso while providing a partial screen from the sun.

BACKGROUND

Walking around amusement parks, beaches, water parks, or anywhere during a warm sunny day can quickly cause an individual to become overheated and dehydrated. When this happens, people can suffer from sun burn, heat stroke or heat exhaustion, which can become uncomfortable and even dangerous. To avoid these consequences, people often leave the beach or park early. As tickets to amusement and theme parks are expensive, having to leave early can create an economic disincentive to attend those venues. Others try to find areas shaded from the sun or go indoors where there is air conditioning. Additionally, at these large public places, children can easily wander off and become lost. They may not be able to find their way back to their companions or parents.

Consequently, there exists a need for an apparatus designed to conveniently keep a person cool and protected from the sun and high temperatures while at places such as beaches, amusement parks, and the like. The proposed invention allows a user to circulate cooled air around their head and torso while simultaneously shading their body from the direct sunlight. The circulation of cooled air along with the shading allows the user to remain outdoors longer and decreases the likelihood of over exposure to the sun and from overheating. Additionally, the invention features a position indicator that alerts others should the user be a child or elderly person that becomes lost or separated from their companions or parents.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a portable sun screen and cooling apparatus for circulating cooled air around a user's head and torso while simultaneously providing shade from the sun without impeding the user's vision. The portable sun screen and cooling apparatus comprises an umbrella element, an air conditioning element, and an indicating element. Additionally, the umbrella element comprises an opaque portion for directly blocking sunlight.

Furthermore, in a preferred embodiment of the invention, the umbrella element comprises a deeply domed canopy wherein a portion of the canopy is essentially transparent so that a user can see through it. A second portion of the canopy is essentially opaque to shade the user from direct sunlight. The umbrella element further comprises a hollow frame extending from a hollow pole. Cooled air is pushed through the hollow pole into the hollow frame by the air conditioning element. The cooled air exits the hollow frame through a plurality of outlet holes that further direct the cooled air onto the user's head and upper body. The portable sun screen and cooling apparatus further comprises an indicating element for alerting others to the position of the user in the event they become lost or separated from their companions.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
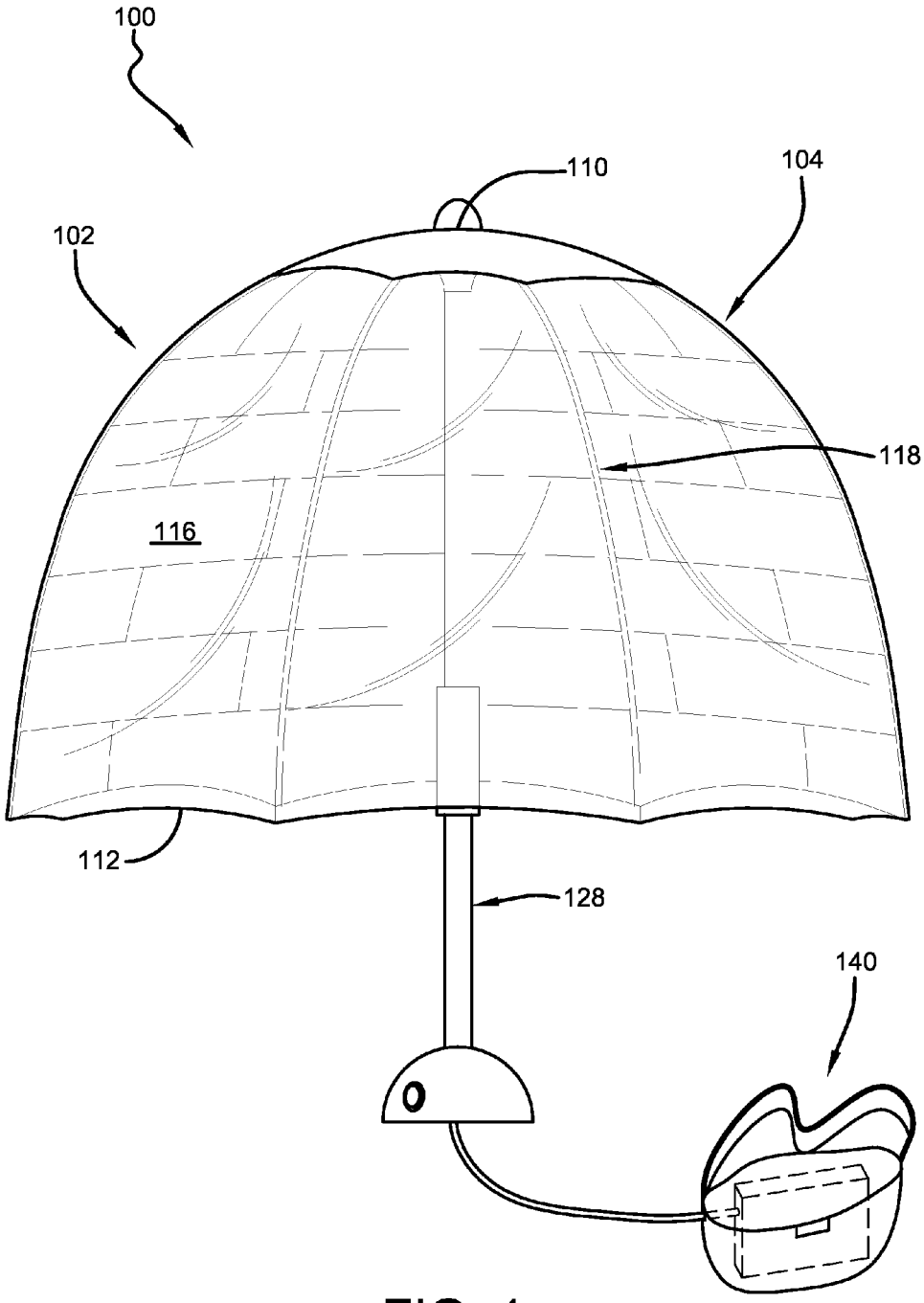
FIG. 1 illustrates a front perspective view of a portable sun screen and cooling apparatus in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter. The invention relates generally to an apparatus for shading a user from direct sunlight while circulating cooled air around the user's head and torso Referring initially to the drawings, FIG. 1 illustrates a portable sun screen and cooling apparatus 100. The portable sun screen and cooling apparatus 100 is for use by individuals engaged in outdoor activities where over exposure to sunlight and warm temperatures is a concern, such as but not limited to visits to amusement parks, beaches, concerts, zoos, and the like. The portable sun screen and cooling apparatus 100 provides circulation of cooled air, shading from the sun, and will indicate a position of a user should they become separated from their companions.

The portable sun screen and cooling apparatus 100 comprises an umbrella element 102 and an air conditioning element 140. The umbrella element 102 comprises a domed canopy 104 resembling a deep domed umbrella, a hollow frame 118, and a hollow pole 128. The domed canopy 104 is typically an elongated dome comprising an interior, an exterior, an apex 110, and a lipped periphery 112. In a preferred embodiment, the domed canopy 104 may be approximately three feet in height and approximately two feet in diameter. This is preferable as this shape keeps cooled air closer to the user than a flatter dome shape. However, the exact shape may vary according to the size of the user. For example, a child's version may be approximately two feet in height and approximately 18 inches in diameter. The only limitation on the ratio of height to diameter is that the height will be longer than the diameter.

Figure 2:
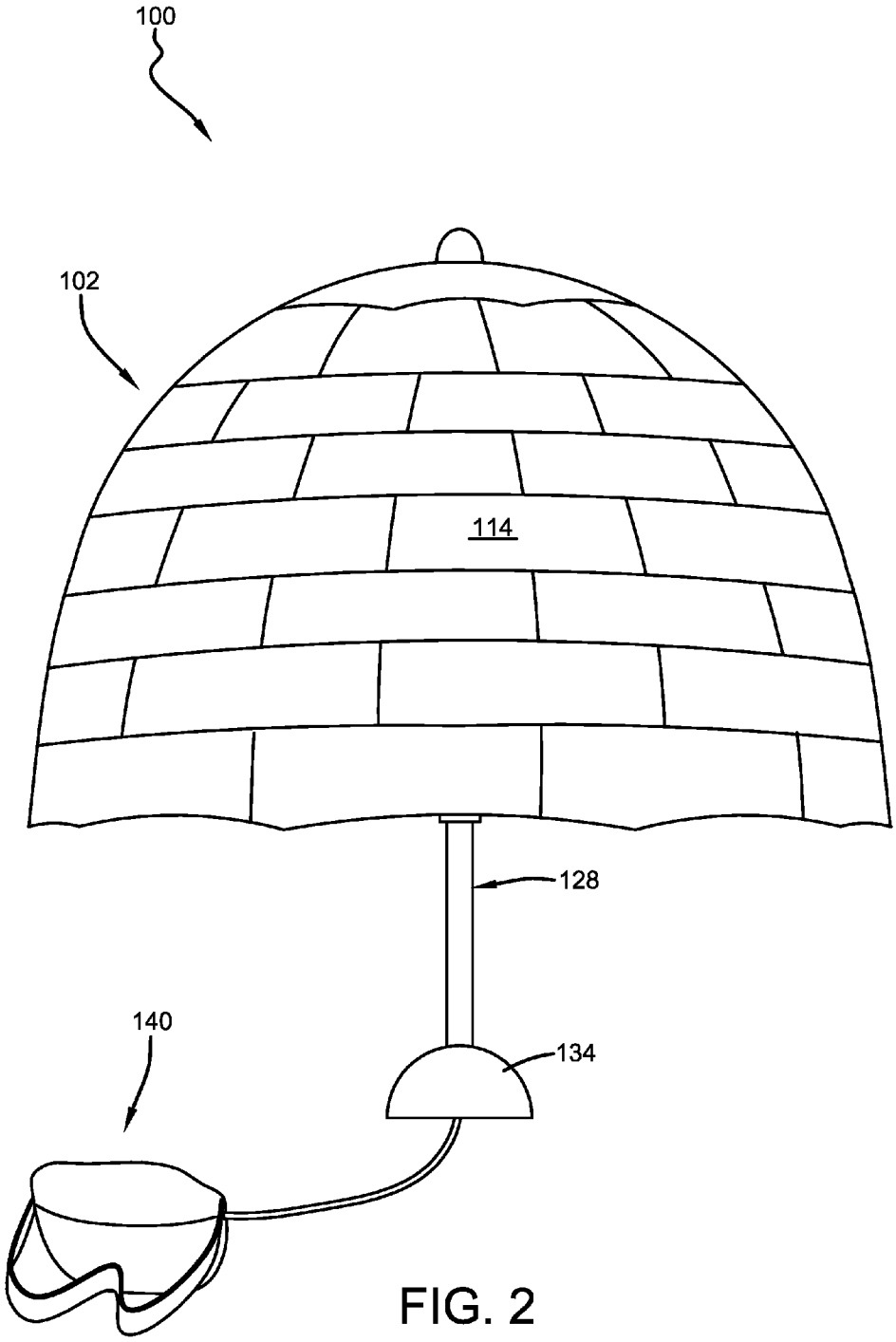
FIG. 2 illustrates a rear perspective of an umbrella element of the portable sun screen and cooling apparatus in accordance with the disclosed architecture.

As illustrated in FIGS. 1-2, the domed canopy 104 further comprises a first portion 114 and a second portion 116. The first portion 114 is generally opaque and will be angled to protect a back of the user. The first portion 114 may comprise an igloo pattern that is thin and shaded white to help block sunlight and provide shade. However, the first portion 114 may comprise any color or design desired by the user as well. The first portion 114 is typically at least 25 percent of the domed canopy 104. However, the first portion 114 may comprise up to approximately 75 percent of the domed canopy 104. The second portion 116 is generally transparent or clear comprising the rest of the domed canopy 104, and angled to protect a front of the user. This permits the user to see through the domed canopy 104 while keeping it in place over their upper body.

The lipped periphery 112 is generally scalloped around a circumference of a bottom of the domed canopy 104. The lipped periphery 112 extends approximately between ½ and 2½ inches substantially inward toward the hollow pole 128. The lipped periphery 114 is angled approximately perpendicularly to the bottom of the domed canopy 104. The purpose of the lipped periphery 114 is to redirect cooled air toward the user when pumped through the portable sun screen and cooling apparatus 100 as described infra.

Figure 3:
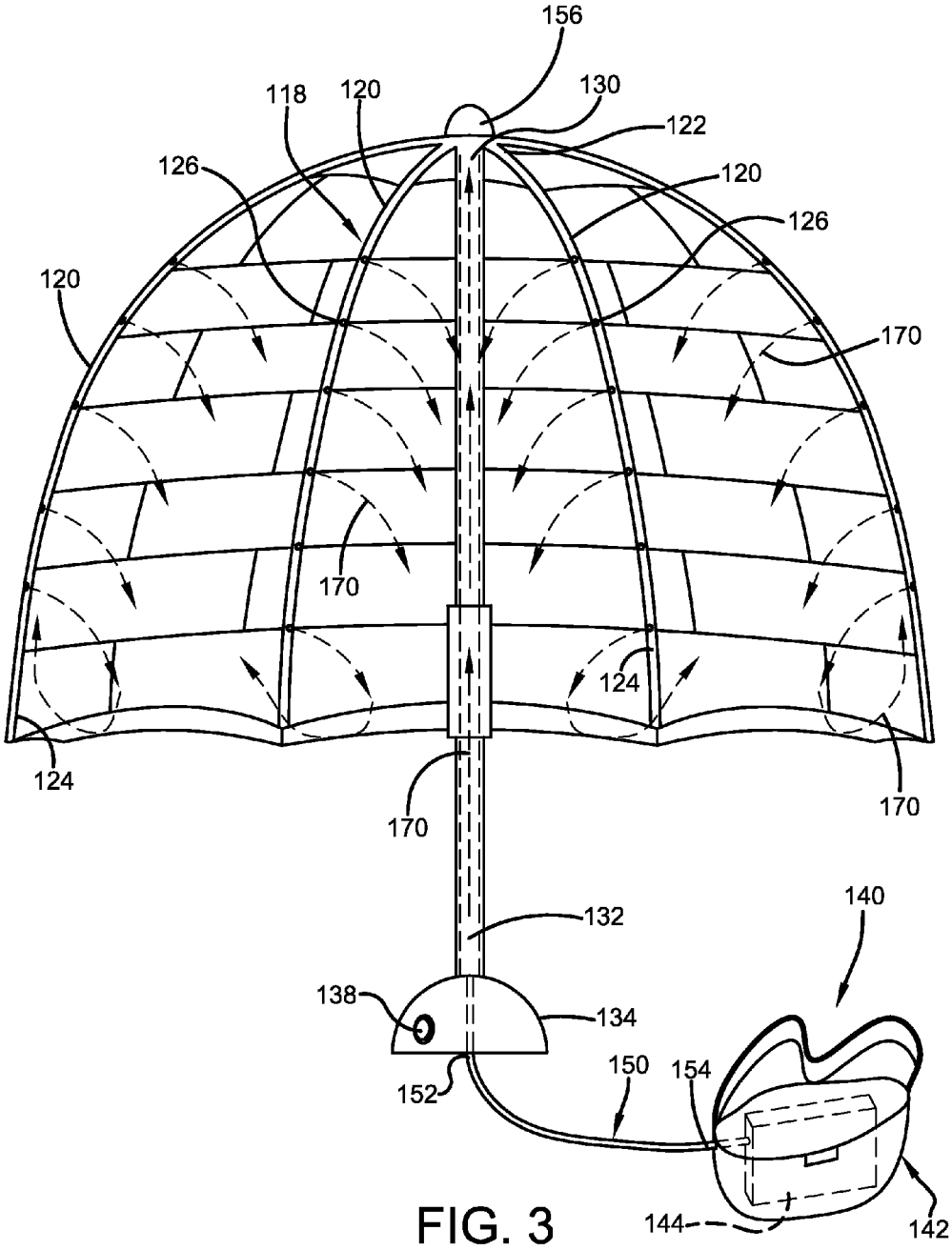
FIG. 3 illustrates a perspective view of the portable sun screen and cooling apparatus demonstrating a flow of cooled air in accordance with the disclosed architecture.

As illustrated in FIGS. 1 and 3, the hollow frame 118 comprises a plurality of articulating tubes 120 each comprising a first end 122, a second end 124, and a plurality of outlet holes 126. The hollow frame 118 is attachable to the interior of the domed canopy 104 the same way as in any other umbrella and may fold up to collapse the domed canopy 104 when not in use. Each of the plurality of articulating tubes 120 are hollow to permit the passage of air. The first ends 122 are connected at the apex 110 of the domed canopy 104.

The hollow pole 128 comprises a top end 130, a bottom end 132, and a handle 134. Although not shown, the hollow pole 128 may also further comprise the plurality of outlet holes 126 as well. The hollow pole 128 extends from the apex 110 down out of the domed canopy 104. The top end 130 of the hollow pole 128 connects to the first ends 122 of each of the plurality of articulating tubes 120. Additionally, the hollow pole 128 may be adjustable in length comprising a plurality of telescoping sections similar to collapsible poles found in other umbrellas. The handle 134 may comprise a control switch 138 for operating the air conditioning element 140. Alternatively, the control switch 138 may be located on the air conditioning element 140. The handle 134 may also comprise a battery back for powering the air conditioning element 140. The handle 135 may comprise a rubberized or plastic grip, or any other umbrella handle known to one of skill in the art.

The air conditioning element 140 comprises a portable air conditioned 144 and a supply tubing 150. The portable air conditioner 144 is typically a portable battery operated air conditioner. Furthermore the portable air conditioner 144 is in fluid communication with the hollow pole 128 through the supply tubing 150. A first end 152 of the supply 150 tubing extends from the portable air conditioner 144, and a second end 154 of the portable air conditioner 144 connects to the hollow pole 128 through an inlet (not shown) in the handle 138. The air conditioning element 140 may be carried in a fanny pack 142, back pack, waist belt, or any other holder known to one of skill in the art that does not require the user to hold the portable air conditioner 144 in their hand.

The control switch 138 is used to activate and control a flow of cooled air 170 into the hollow pole 128, through the plurality of articulating tubes 120, and out of the plurality of outlet holes 126. The plurality of outlet holes 126 generally direct the flow of cooled air 170 toward the user. The lipped periphery 112 also helps redirect the flow of cooled air 170 that runs along the interior of the domed canopy 104 and would otherwise run out of a bottom of the domed canopy 104. As the cooled air flows downward along the interior of the domed canopy 104, the lipped periphery 112 deflects that air inward toward the user's torso.

The portable sun screen and cooling apparatus 100 may further comprise an indicating element 156. The indicating element 156 may be used to show the user's position should they become lost or separated from their companions. For example, if a child becomes lost at an amusement park, they can use the indicating element 156 as a "panic button" to alert their parents to their position from a distance. The indicating element 156 is typically located on the exterior of the domed canopy 104 at the apex 110 extending from the top end 130 of the hollow pole. The indicating element 156 is in electronic communication with the control switch 138 located in the handle 134. The indicating element 156 may comprise a visible indicator, an audible indicator, or both. The visible indicator will typically be a flashing light or strobe light. The audible alert may comprise an electronic beeping noise.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A portable sun screen and cooling apparatus comprising:

an umbrella element comprising:

a domed canopy comprising an apex, an interior, an exterior, and a lipped periphery, wherein a first portion of the domed canopy is opaque and a second portion is transparent; and a hollow frame attached to the interior of the domed canopy, wherein the hollow frame comprises a plurality of articulating tubes and a plurality of outlet holes; and a hollow pole comprising an adjustable length extending downward out of the hollow frame from the apex, wherein the lipped periphery is scalloped and extends inward approximately between ½ and 2½ inches substantially perpendicular to the hollow pole; and an air conditioning element in fluid communication with the umbrella element for moving cooled air through the interior of the domed canopy, wherein the lipped periphery redirects the cooled air flowing downward along the domed canopy inward towards the hollow pole; and a user's position indicating element located on the umbrella element.

2. The portable sun screen and cooling apparatus of claim 1, wherein the user's position indicating element is an audible indicator.

3. The portable sun screen and cooling apparatus of claim 1, wherein the user's position indicating element is a visible indicator.

4. The portable sun screen and cooling apparatus of claim 1, wherein the user's position indicating element comprises an audible indicator and a locating beacon.

5. The portable sun screen and cooling apparatus of claim 4, wherein the hollow pole further comprises a control switch for activating the indicating element and for activating a flow of cooled air from the air conditioning element through the portable sun screen and cooling apparatus.

6. The portable sun screen and cooling apparatus of claim 5, wherein the opaque portion of the domed canopy comprises a fabric that blocks ultraviolet light.

7. The portable sun screen and cooling apparatus of claim 6, wherein the transparent portion of the domed canopy comprises between approximately twenty-five and fifty percent of the domed canopy.

* * * * *